United States Patent [19]

Day et al.

[11] 4,409,813

[45] Oct. 18, 1983

[54] METHOD AND APPARATUS FOR CORRUGATING STRIPS

[75] Inventors: Jack R. Day, Oak Ridge; Charles H. Curtis, Kingston, both of Tenn.

[73] Assignee: The United States of America as represented by the U.S. Department of Energy, Washington, D.C.

[21] Appl. No.: 315,380

[22] Filed: Oct. 27, 1981

[51] Int. Cl.[3] ..... B21C 37/02; B21D 13/02

[52] U.S. Cl. ..... 72/190; 72/385; 72/379

[58] Field of Search ..... 72/160, 163, 184, 187, 72/190, 191, 384, 385, 469, 483, 379, 380, 383, 196

[56] References Cited

U.S. PATENT DOCUMENTS

| | | | |
|---|---|---|---|
| 1,727,894 | 9/1929 | Moyer | 72/190 |
| 2,643,688 | 6/1953 | Crooker | 72/196 |
| 3,064,694 | 11/1962 | Brook et al. | 72/190 |
| 3,641,803 | 2/1972 | Schuurbiers | 72/385 |
| 3,670,781 | 6/1972 | Liouville | 72/190 |

*Primary Examiner*—Lowell A. Larson

*Attorney, Agent, or Firm*—Fred O. Lewis; Stephen D. Hamel; Richard G. Besha

[57] ABSTRACT

The invention relates to a method and a machine for transversely corrugating a continuous strip of metallic foil. The product foil comprises a succession of alternately disposed corrugations, each defining in cross section, a major segment of a circle. The foil to be corrugated is positioned to extend within a vertical passage in the machine. The walls of the passage are heated to promote the desired deformation of the foil. Foil-deforming rollers are alternately passed obliquely across the passage to respectively engage transverse sections of the foil. The rollers and their respective section of deformed foil comprise a stacked assembly which is moved incrementally through the heated passageway. As the assembly emerges from the passageway, the rollers spill from the corrugated foil and are recovered for re-use.

12 Claims, 9 Drawing Figures

17
1
2
59

1
2
59

1
2
3
61

1
2
3
4
59

17
1
2
3
4
5
61

METHOD AND APPARATUS FOR CORRUGATING STRIPS

The invention is a result of a contract with the United States Department of Energy.

BACKGROUND OF THE INVENTION

The invention relates generally to methods and apparatus for corrugating flat metallic foil.

The invention was developed in response to a need for a relatively simple machine for rapidly forming a continuous succession of identical, alternate, transverse corrugations in long ribbons of aluminum-alloy foil, each corrugation defining a circle-arc exceeding 180°—i.e., a major segment of a circle. Such corrugations are especially useful in various load-bearing applications, as in lightweight structural material for satellites. Conventional machines of the hydraulic, mating-gear, or roll-forming types are not well suited for forming such corrugations.

Accordingly, it is an object of this invention to provide a novel method and machine for corrugating flat metallic foil.

It is another object to provide a method and machine for forming transverse corrugations in a continuous strip or ribbon of metallic foil.

It is still another object to provide a method and machine for forming similar corrugations in deformable flat materials each corrugation defining in cross section a major segment of a circle.

Other objects and advantages of the invention will be made evident hereinafter.

SUMMARY OF THE INVENTION

In one aspect, the invention is a machine for forming corrugations in a length of metallic foil. The machine includes a plurality of cylindrical rollers for forming the desired corrugations. The body of the machine is formed with a vertical passage including a lower expanded section and an upper reduced section. The reduced section has a width which is defined by opposed sidewalls, the width being more than one roller diameter and less than two roller diameters. The machine also includes means for positioning a length of the foil under selected tension in the vertical passage, with the faces of the foil confronting the sidewalls of the passage. First reciprocatable roller-supporting means are provided for conveying a first roller across the lower part of the passage to engage the roller with a transverse section of a face of the length of foil and convey the first-roller-engaged section to an elevated position alongside one of the sidewalls of the passage. Second reciprocatable roller-supporting means are provided for conveying a second roller across the lower part of the passage to engage it with a transverse section of the other face of the length of foil and convey the second-roller-engaged section to an elevated position alongside the other of the sidewalls where it displaces the first-roller-engaged section out of its elevated position and upwardly in said passage.

In another aspect, the invention is a method for transversely corrugating a length of metallic foil. The method includes the following operations: A plurality of cylindrical rollers is provided for deforming the foil. A body is provided, the body having a passage including an expanded lower section and a reduced upper section, the latter having a pair of opposed sidewalls which define a spacing exceeding one roller diameter and less than two roller diameters. A length of the foil to be corrugated is positioned, under selected tension, to extend longitudinally through the expanded lower section. A stack of the rollers is provided in the upper section of the passage, the stack being disposed as two vertical, adjacent, staggered rows. A first additional roller is conveyed across the lower section of the passage to engage a transverse section of the length of foil and carry it to an elevated position in the upper section to displace (1) the lowermost roller, (2) the portion of foil engaged therewith, and (3) the remainder of the stack upwardly in the upper section. A second roller then is conveyed across the lower section of the passage to engage another transverse section of the foil and carry the same to a position in said upper section to displace (1) the first roller, (2) the section of foil engaged with the first roller, and (3) the remainder of the stack of rollers upwardly in the passage. Other additional rollers are alternately conveyed in similar fashion.

DETAILED DESCRIPTION OF THE INVENTION

The invention is applicable to forming various corrugations of circle-arc configuration in various kinds of deformable materials. For brevity, it will be illustrated as applied to the formation of a continuous succession of identical corrugations in a strip of aluminum foil, each corrugation having a cross-sectional shape approximating a major segment of a circle.

Figure 1:
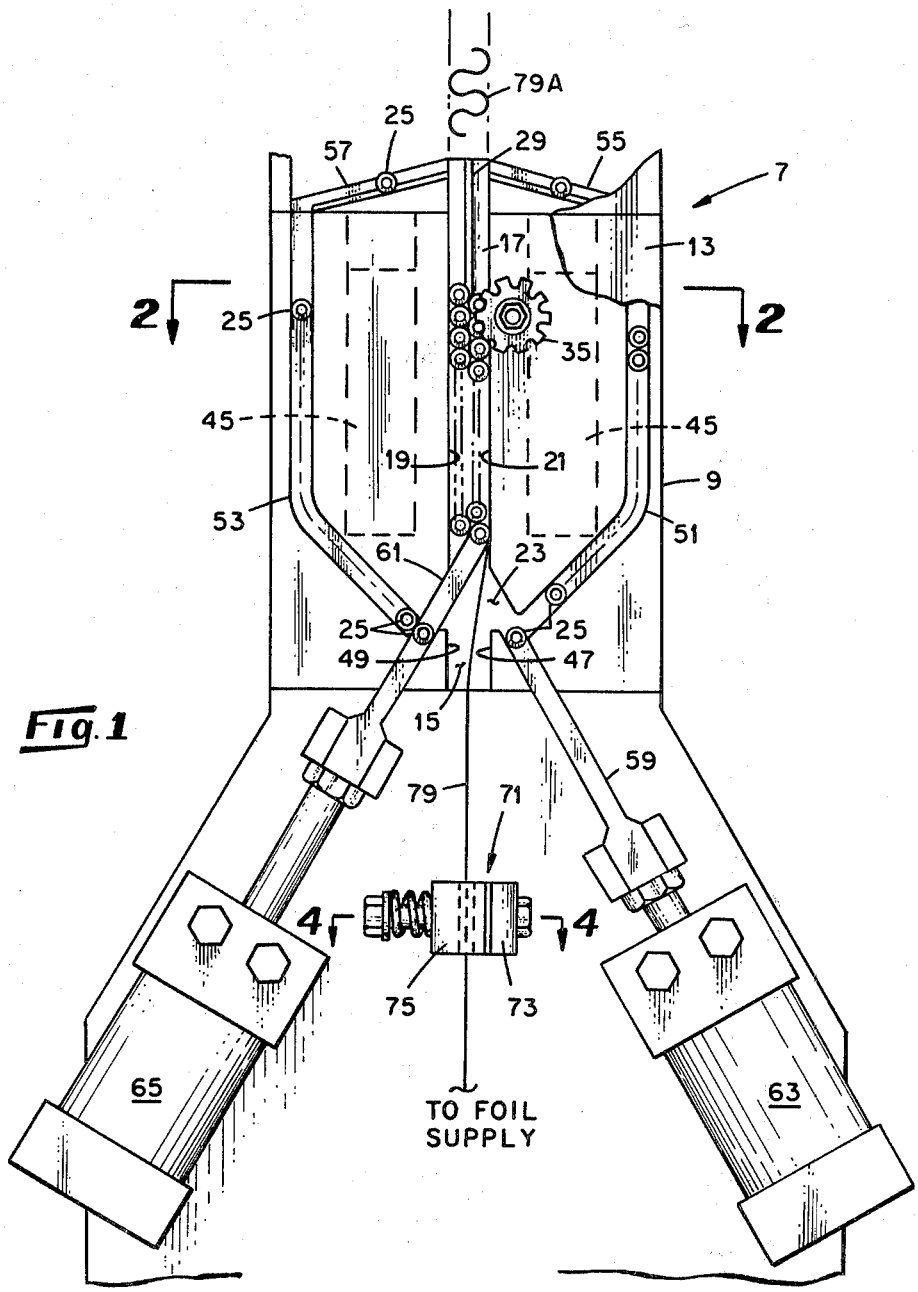
FIG. 1 is a front view, partly cut away, of a foil-bending machine designed in accordance with the invention, a portion of corrugated foil product 79A being shown.

Referring to the figures, a preferred embodiment of a machine designed for the above-mentioned application comprises a vertically disposed assembly 7 including a body 9 provided with a backplate 11 and a frontplate 13. The body 9 is formed with a central, vertical, through-going passage 15 which includes (a) a reduced upper section 17 whose width is defined by parallel sidewalls 19 and 21 and (b) an expanded lower section 23. The upper section 17 is designed to slidably accommodate a stack of identical, horizontally disposed, cylindrical rollers 25 (FIG. 2) each having axially extending pins 27 at its ends. The upper section 17 is designed with a width of more than one roller diameter and less than two roller diameters, so that the stack of rollers consists of two adjacent, vertical, staggered rows (FIG. 1). Means (to be described) are provided for supporting the bottom of the stack and for intermittenly moving the stack upwardly through the section 17. The rear wall of the upper section 17 is formed with a vertical rib 29 (FIG. 1) which extends between adjacent rearward pins of the two rows of rollers to maintain the rows in the desired orientations shown. Four wells 45 (FIG. 2) are provided in the body 9 for receiving electrical heaters (not shown) for maintaining the section 17 and its contents at a controlled operating temperature.

Figure 2:
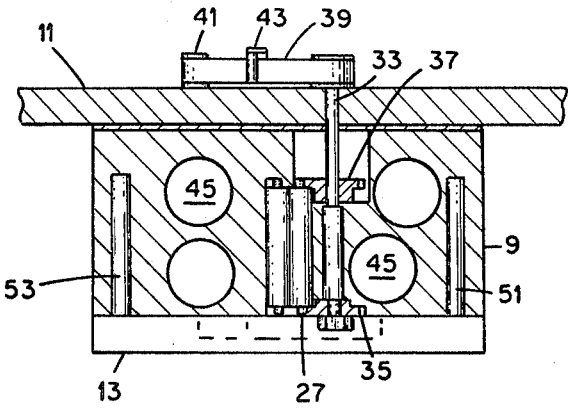
FIG. 2 is a sectional view taken along line 2—2 of FIG. 1.

Referring to FIGS. 1 and 2, the upper portion of the body 9 carries an assembly for retarding, or braking, upward movement of the stack of rollers in the upper section 17 of the passage 15, thus maintaining the stack in a compact array. The braking assembly includes a horizontal, rotatable shaft 33 (FIG. 2) which extends through the body 9 and backplate 11. Affixed to the shaft are two notched wheels 35 and 37, which extend into the upper section 17 for circumferential engagement by the pins 27 of rollers in the adjacent vertical row of the stack. A tetrafluoroethylene-coated metal strap 39 (FIG. 2), is supported by the backplate 11 and hooked on a pin 41. Any suitable means 43 is provided for adjusting the tension of the strap to vary the drag on the shaft 33. Thus, upward movement of the stack of rollers is braked to a selected extent by engagement with the wheels 35 and 37.

Figure 3:
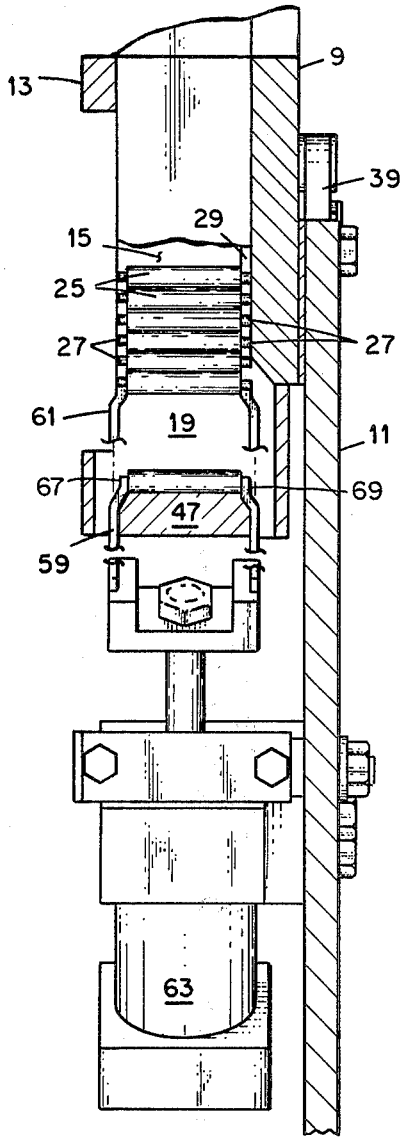
FIG. 3 is a partly sectional lateral view taken along the centerplane of FIG. 1.

Referring to FIGS. 1 and 3, the expanded section 23 of the passage 15 contains means 47 and 49 having concave upper faces for respectively supporting two of the rollers 35 in positions where they extend horizontally and parallel to the sidewalls 19 and 21 of upper section 17. As indicated in FIG. 3, the pins of the supported rollers extend beyond their respective supports. The body 9 is formed with channels 51 and 53 for serially returning horizontally disposed rollers by gravity to the support means 47 and 49, respectively, for re-use in forming additional foil. Ramps 55 and 57 are provided on either side of the top end of passage 15 to receive horizontally disposed rollers issuing from the passage and guide them into the channels 51 and 53, respectively. Thus, the machine can corrugate continuous lengths of foil.

As shown in FIGS. 1 and 3, generally U-shaped forks 59 and 61 are individually associated with the roller-supports 47 and 49. The open ends of the forks extend within the lower end of body 9 and span their associated roller-supports 47 and 49. The open end of each fork comprises opposed resilient arms which terminate in converging notched tips 67 and 69 (FIG. 3) for releasably engaging the pins of a roller positioned as described. The forks operate in analogous fashion and are respectively reciprocated by any suitable means, such as external pneumatic cylinders 63 and 65. Each fork is movable between a first position where it makes engagement with the pins of a roller supported as described and a second position where it maintains the engaged roller in an elevated position alongside the opposite wall of the upper section 17. That is, in its ascending movement each fork engages a roller and, without altering its orientation, conveys it obliquely across the passage 15 to a more elevated position alongside the opposite wall of section 17.

The actuators for the forks are synchronized so that at any given time, one of the forks is in the elevated position. FIGS. 1 and 3 illustrate a moment where (a) fork 61 has just delivered a roller to its elevated position and (b) fork 59 has reached a retracted position where it engages the pins of a roller positioned on support 47. Now fork 59 is advanced toward its elevated position, and as it approaches that position its tips move between the arms of fork 61, spreading them and releasing the roller carrier thereby, after which fork 61 is retracted. As the roller carried by fork 59 reaches its elevated position, it displaces the entire stack of rollers and foil upwardly in section 17 and supports them therein. As fork 61 approaches its retracted position, its tips are forced farther apart by the pins of the roller positioned on support 49. When fork 61 is fully retracted, the notches in the tips engage the pins on the rollers.

Figure 4:
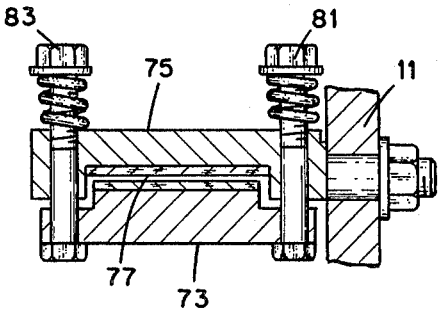
FIG. 4 is a sectional view taken along line 4—4 of FIG. 1, and FIGS. 5*a* to *e* are series of schematic diagrams illustrating the manner in which corrugations are formed by the machine shown in FIGS. 1–4.

Referring now to FIGS. 1 and 4, the backplate 11 carries an assembly 71 for maintaining selected tension on a strip of foil 79 extending upwardly through the assembly and into the passage 17. As indicated, the assembly receives the foil from any suitable supply, such as a reel (not shown). The assembly includes pads 73 and 75 having cork-lined faces which define a passageway 77 for the foil. The pads are coupled by conventional bolt-and-spring arrangements 81 and 83 which permit adjustment of the compression on the slot and the tension on the strip of foil.

Prior to a normal operation of the assembly 7, a strip of foil 79 is fed manually through the guide assembly 71 and positioned along the axis of passage 15. With, say, fork 61 holding a roller in the elevated position, the upper section 17 of passage 15 is filled manually with rollers, to form a stack of the kind shown in FIG. 1. The stack is engaged with the braking wheels 35 and 37. The feed channels 51 and 53 are manually loaded with rollers, and the heaters 45 are energized to bring the roller stack to a temperature promoting permanent deformation of the foil. The actuators for forks 59 and 61 then are energized to alternately convey rollers to opposed elevated positions in the upper section 17 of passage 15, each roller carrying with it a loop of the foil strip 79. Each foil-carrying roller is inserted in the bottom of the stack and displaces the stack upwardly, against the braking action of the wheels 35 and 37. As will be described in the following paragraph, the insertion of the rollers forms a section of corrugated foil which moves upwardly with the stack, issuing from the upper end of section 17. As the stack leaves the confines of section 17, the corrugations open somewhat. Any suitable means (not shown) is provided for alternately flexing the emerging stack-and-foil assembly to the left and right to discharge the rollers onto the ramps and thence to the feed channels 51 and 53. The resulting roller-free corrugated foil 79A is shown in FIG. 1.

Figures 5A, 5B, 5C, 5D, 5E:
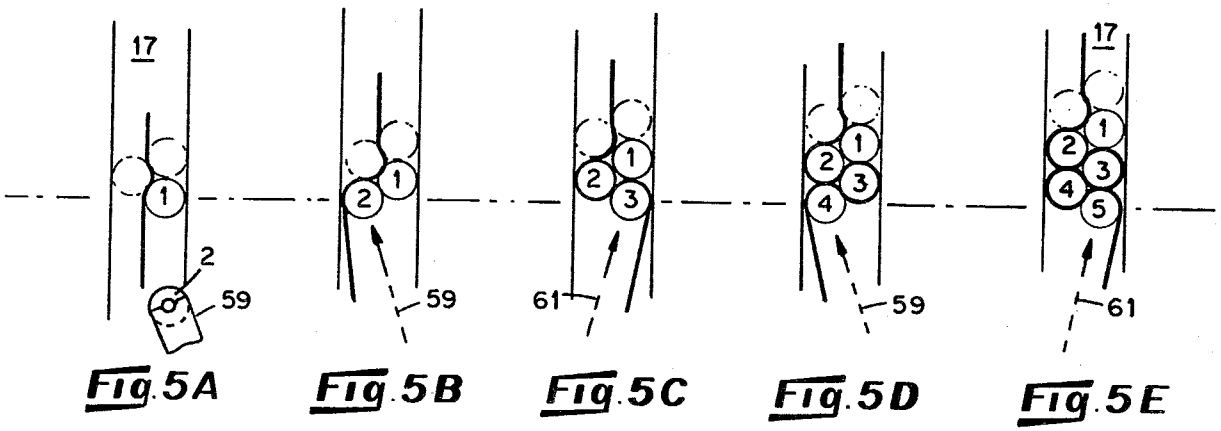

FIGS. 5A–5E illustrate schematically how the rollers conveyed to section 17 cooperatively corrugate the foil. FIG. 5A illustrates an initial condition where the foil 71 has been centered manually in section 17 and a stack of rollers (represented by broken lines) has been formed manually in the section. The stack now is supported by a roller designated as 1, which is maintained in elevated position by fork 61 (not shown). FIG. 5B shows the arrangement after fork 59 has been moved (in the direction shown by an arrow) to convey a roller 2 obliquely across lower section 23 to an elevated position in section 17. When roller 2 is so conveyed, it engages a transverse section of the foil strip 71 and carries it to the elevated position as shown. During its ascent, fork 59 spreads the tips of fork 61, releasing the roller engaged thereby. When roller 2 reaches its elevated position, it upwardly displaces roller 1 and any rollers above it and supports the stack. Fork 61 is retracted. FIG. 5C shows the arrangement after fork 61 has been actuated to deposit another foil-carrying roller (3) in elevated position. Roller 2 and the stack now have been displaced upwardly, and rollers 2 and 3 have cooperatively bent the web of foil therebetween into a generally S shape. FIG. 5D shows the arrangement after fork 59 has deposited another foil-engaging roller 4 in elevated position so that the stack is displaced upwardly and so that rollers 3 and 4 cooperatively deform the web of foil between them into a generally S shape. In FIG. 5E, fork 61 has delivered foil-carrying roller 5 to its elevated position, and rollers 4 and 5 have cooperatively deformed the web of foil therebetween as shown. In other words, foil-carrying rollers are alternately inserted in the bottom of the stack to form a corrugated strip of foil 9A (FIG. 1) having corrugations of the desired shape (79A, FIG. 1).

A machine of the kind described was used to form continuous, uniform corrugations in commercially available aluminum foil. In a typical test, the foil was a strip of Type 505 6H19 aluminum alloy. The strip had a thickness of 2 mils and a width of up to one inch. The rollers used to form the corrugations were composed of steel; they had an overall length of 1.19" and a body diameter of 0.187". Tests demonstrated that the wavelength (distance from a crest to the next adjacent crest) of the corrugated strips was a function of temperature and residence-time in the machine. In one series of tests in which the foil was fed through the machine at a constant rate, the wavelength varied with machine temperature as follows: 75° F., 0.83"; 200° F., 0.6"; 300° F., 0.4"; 400° F., 0.25". Typical operating rates were in the range of: 20–30 pins per minute, or 11.75" to 17.6" of foil feed per minute.

The foregoing description of a preferred embodiment of the invention has been presented for purposes of illustration and is not intended to be exhaustive or to limit the invention to the precise form disclosed. Obviously, many modifications and variations are possible in light of the above teaching. It is intended that the scope of the invention be defined by the claims appended hereto.

What is claimed is:

1. Apparatus for forming corrugations in a length of metallic foil, comprising:

(a) a plurality of cylindrical rollers for forming corrugations in said foil, (b) a body formed with a vertical passage having an expanded lower section and a reduced upper section, the latter having a width defined by opposed parallel sidewalls, said width being more than one roller diameter and less than two roller diameters, (c) means for positioning a length of said foil under selected tension in said passage, the faces of said foil confronting said sidewalls, (d) first reciprocatable roller-supporting means for conveying a first roller across the lower part of said passage to engage the roller with a transverse section of a face of said length of foil and convey the first-roller-engaged section to an elevated position alongside one of said walls, and (e) second reciprocatable roller-supporting means for conveying a second roller across the lower part of said passage to engage it with a transverse section of the other face of said length of foil and convey the second-roller-engaged section to an elevated position alongside the other of said walls where it displaces the first-roller-engaged section out of its elevated position and upwardly in said passage.

2. The apparatus of claim 1 further comprising means for heating said sidewalls to a temperature promoting permanent deformation of said foil in said upper section of said passage.

3. The apparatus of claim 1 wherein said roller have axial endwise projections.

4. The apparatus of claim 1 wherein said means for conveying rollers comprises a pair of forks having tips for releasably engaging the projections of one of said rollers.

5. Apparatus for forming corrugations in a length of metallic foil, comprising:

(a) a plurality of similar cylindrical rollers for forming corrugations in said foil, (b) a body formed with a vertical passage having an expanded lower section and a reduced upper section, the latter having a width defined by opposed parallel sidewalls, said width being more than one roller diameter and less than two roller diameters.

(c) means for positioning a length of said foil under selected tension in said passage, the faces of said foils confronting said sidewalls, (d) first positioning means for releasably engaging one of said rollers and conveying the same across said lower section to engage a transverse portion of said length of foil and carry the same to an elevated position in said upper section where said roller extends horizontally alongside one of said sidewalls, (e) second positioning means for similarly engaging and conveying another roller to engage another transverse portion of said foil and carry the same to a corresponding elevated position alongside the other of said sidewalls, and (f) means for reciprocating said positioning means to alternately deliver rollers to their respective elevated positions and for maintaining one or the other of said positioning means in elevated position at any given time, whichever positioning means that is ascending causing the other to release its elevated roller, the roller carried by the ascending positioning means displacing the released roller and the foil portion engaged therewith upwardly in said upper section and supporting it therein.

6. The apparatus of claim 5 further comprising heating means in said body for maintaining said sidewalls at a temperature promoting permanent deformation of said foil in the upper section of said passage.

7. The apparatus of claim 5 further comprising braking means acting on the rollers in said upper section to maintain them in a compact array.

8. The apparatus of claim 5 wherein said rollers have endwise projections for engagement by said positioning means.

9. A method for transversely corrugating a length of metallic foil, comprising:

(a) providing a plurality of like cylindrical rollers for deforming said foil, (b) providing a body having a passage including an expanded lower section and a reduced upper section, the latter having a pair of opposed sidewalls defining a spacing exceeding one roller diameter and less then two roller diameters, (c) providing in said passage a length of said foil which extends longitudinally through said lower section thereof and is under selected tension, (d) providing in the upper section of said passage a stack of said rollers disposed as two vertical, adjacent, staggered rows, (e) conveying a first additional roller across said lower section of said passage to engage a transverse section of said length of foil and carry the same to an elevated position in said upper section to displace the lowermost roller of said stack and the remainder of the stack upwardly in said passage, (f) conveying a second additional roller across said lower section of said passage to engage another transverse section of said length of foil and carry the same to a position in said upper section to displace the first roller, the section of foil engaged with the latter, and the remainder of said stack upwardly in said passage, and (g) repeating steps (e) and (f) with other additional rollers.

10. The method of claim 9 wherein said sidewalls are heated to promote permanent deformation of said foil in the upper section of said passage.

11. The method of claim 9 further characterized by the step of braking the upward movement of said rollers in the upper section of said passage to maintain them in a compact array.

12. The method of claim 9 wherein said first and second rollers are conveyed obliquely across said lower section of said passage.

* * * * *